US010968075B2

(12) United States Patent
Taudou et al.

(10) Patent No.: US 10,968,075 B2
(45) Date of Patent: Apr. 6, 2021

(54) ELEVATOR CAR LOCATION ZONES IN HOISTWAY

(71) Applicant: Otis Elevator Company, Farmington, CT (US)

(72) Inventors: Christophe Taudou, La Bussiere (FR); Nicolas Fonteneau, Vitry aux Loges (FR); Clement Schach, Orléans (FR); Raphael Picard, Gien (FR); Thierry Chopineau, Gien (FR); Patrice Degardin, Chatillon sur Loire (FR); Alexandre Renard, Gien (FR)

(73) Assignee: OTIS ELEVATOR COMPANY, Farmington, CT (US)

( * ) Notice: Subject to any disclaimer, the term of this patent is extended or adjusted under 35 U.S.C. 154(b) by 632 days.

(21) Appl. No.: 15/740,486

(22) PCT Filed: Jun. 30, 2015

(86) PCT No.: PCT/IB2015/001343
§ 371 (c)(1),
(2) Date: Dec. 28, 2017

(87) PCT Pub. No.: WO2017/001883
PCT Pub. Date: Jan. 5, 2017

(65) Prior Publication Data

US 2018/0186601 A1 Jul. 5, 2018

(51) Int. Cl.
*B66B 5/00* (2006.01)
*B66B 13/24* (2006.01)
*B66B 11/00* (2006.01)

(52) U.S. Cl.
CPC ..... *B66B 5/0087* (2013.01); *B66B 11/0005* (2013.01); *B66B 13/24* (2013.01)

(58) Field of Classification Search
CPC .... B66B 5/0087; B66B 11/0005; B66B 13/24
(Continued)

(56) References Cited

U.S. PATENT DOCUMENTS 4,354,171 A * 10/1982 Yoshida ..... B66B 1/3492 187/394
5,476,157 A * 12/1995 Todaro ..... B66B 13/24 187/280

(Continued)

FOREIGN PATENT DOCUMENTS

DE 102012005541 A1 9/2013
EP 1321423 A1 6/2003

(Continued)

OTHER PUBLICATIONS

International Search Report for International Application No. PCT/IB2015/001343; International Filing Date Jun. 30, 2015; dated Mar. 11, 2016, 7 pages.

(Continued)

*Primary Examiner* — Jeffrey Donels
(74) *Attorney, Agent, or Firm* — Cantor Colburn LLP

(57) ABSTRACT

An elevator system (10) includes a hoistway (14) having a plurality of landing floors (34) each landing floor (34) having a landing floor door (36). An elevator car (12) is positioned in and drivable along the hoistway (14). A controller (38) restricts operation of the landing floor doors (36) based on a position of the elevator car (12) along the hoistway (14). A method of operating an elevator system (10) includes driving an elevator car (12) along a hoistway (14) of the elevator system (10) and determining a position of the elevator car (12) in the hoistway (14). Operation of a plurality of hoistway landing floor doors (36) is controlled based on the position of the elevator car (12) in the hoistway (14).

11 Claims, 2 Drawing Sheets

(58) Field of Classification Search
USPC ..... 187/247
See application file for complete search history.

(56) References Cited

U.S. PATENT DOCUMENTS

| | | | | |
|---|---|---|---|---|
| 5,509,505 | A * | 4/1996 | Steger | B66B 1/40 187/393 |
| 5,819,877 | A * | 10/1998 | Rivera | B66B 13/12 187/314 |
| 6,032,761 | A * | 3/2000 | Coste | B66B 1/50 187/294 |
| 6,223,861 | B1 | 5/2001 | Sansevero | |
| 2002/0084148 | A1 | 7/2002 | Nygren | |
| 2002/0117358 | A1 | 8/2002 | Schoppa et al. | |
| 2004/0251086 | A1 | 12/2004 | Huber et al. | |
| 2005/0082121 | A1 | 4/2005 | Deplazes | |
| 2008/0047783 | A1 | 2/2008 | Vogl | |
| 2009/0255762 | A1 | 10/2009 | Ketonen et al. | |
| 2009/0321192 | A1 | 12/2009 | Kattainen et al. | |
| 2010/0270109 | A1 | 10/2010 | McCarthy et al. | |
| 2012/0018256 | A1 | 1/2012 | Mangini et al. | |
| 2013/0081909 | A1 * | 4/2013 | Garfinkel | B66B 1/3492 187/394 |
| 2017/0253461 | A1 * | 9/2017 | Villa | B66B 1/3492 |

FOREIGN PATENT DOCUMENTS

| | | | | |
|---|---|---|---|---|
| EP | 1466853 | A1 | 10/2004 | |
| JP | S54146364 | A | 11/1979 | |
| JP | 108059151 | A | 5/1996 | |
| JP | 109052685 | A | 2/1997 | |
| WO | 2006108433 | A1 | 10/2006 | |
| WO | 2011076531 | A1 | 6/2011 | |
| WO | WO2011076531 | * | 6/2011 | B66B 5/00 |
| WO | 2013084279 | A1 | 6/2013 | |

OTHER PUBLICATIONS

Written Opinion for International Application No. PCT/IB2015/001353; International Filing Date Jun. 30, 2015; dated Mar. 11, 2015, 6 pages.

* cited by examiner

ELEVATOR CAR LOCATION ZONES IN HOISTWAY

CROSS REFERENCE TO RELATED APPLICATIONS

This application is a National Stage application of PCT/IB2015/001343, filed Jun. 30, 2015, the entire contents of which are hereby incorporated by reference.

BACKGROUND

The subject matter disclosed herein relates to elevator systems. More particularly, the present disclosure relates to hoistway access control for technicians and/or maintenance personnel.

In current, typical elevator systems, technicians or maintenance personnel often enter the hoistway above or underneath of the elevator car to access elevator system components in the hoistway or to perform maintenance in the hoistway, by entering the hoistway through a hoistway door. In order to protect the mechanics or technicians, etc., during those operations, codes and/or regulations have specified a safety volume and clearance for technicians entering the hoistway resulting in a larger overall volume of the elevator systems. Elevator system customers, however, desire that the elevator system occupy a smaller overall volume. Thus, new elevator systems are being developed in which many maintenance activities can be performed from inside the car, alleviating the need to provide such a safety volume in the pit.

BRIEF SUMMARY

In one embodiment, an elevator system includes a hoistway having a plurality of landing floors each landing floor having a landing floor door. An elevator car is positioned in and drivable along the hoistway. A controller restricts operation of the landing floor doors based on a position of the elevator car along the hoistway.

Additionally or alternatively, in this or other embodiments the hoistway includes a first hoistway zone, such that when the elevator car is positioned in the first hoistway zone the controller allows for opening of a corresponding landing floor door.

Additionally or alternatively, in this or other embodiments the first hoistway zone is defined such that the elevator car is positioned in front of the corresponding landing floor door when positioned in the first hoistway zone.

Additionally or alternatively, in this or other embodiments the corresponding landing floor door is fully openable when the elevator car is positioned in the first hoistway zone.

Additionally or alternatively, in this or other embodiments the hoistway includes a second hoistway zone, such that when the elevator car is positioned in the second hoistway zone the controller allows for opening of a corresponding landing floor door, without allowing entry of a person into the hoistway via the landing floor door.

Additionally or alternatively, in this or other embodiments the second hoistway zone is defined such that a top and or bottom of the elevator car is accessible through the corresponding landing floor door when the elevator car is positioned in the second hoistway zone.

Additionally or alternatively, in this or other embodiments the hoistway includes a third hoistway zone, such that when the elevator car is positioned in the third hoistway zone the controller prevents opening of a corresponding landing floor.

Additionally or alternatively, in this or other embodiments a car position reference system is operably connected to the controller to determine the position of the elevator car in the hoistway.

In another embodiment, a method of operating an elevator system includes driving an elevator car along a hoistway of an elevator system and determining a position of the elevator car in the hoistway. Operation of a plurality of hoistway landing floor doors is controlled based on the position of the elevator car in the hoistway.

Additionally or alternatively, in this or other embodiments the position of the elevator car is compared to two or more predetermined hoistway zones and operation of the hoistway landing floor doors are allowed based on the predetermined zone in which the elevator car is positioned.

Additionally or alternatively, in this or other embodiments a first hoistway zone is defined such that when the elevator car is positioned in the first hoistway zone a corresponding landing floor door is permitted to be opened.

Additionally or alternatively, in this or other embodiments a second hoistway zone is defined, such that when the elevator car is positioned in the second hoistway zone a corresponding landing floor door is permitted to be opened while not allowing a person to enter the hoistway via the landing floor door.

Additionally or alternatively, in this or other embodiments a top and/or bottom of the elevator car is accessed through the corresponding landing floor door when the elevator car is positioned in the second hoistway zone.

Additionally or alternatively, in this or other embodiments a third hoistway zone is defined such that when the elevator car is positioned in the third hoistway zone a corresponding landing floor is prevented from opening.

Additionally or alternatively, in this or other embodiments the position of the elevator car in the hoistway is determined via a car position reference system.

BRIEF DESCRIPTION OF THE DRAWINGS

The subject matter is particularly pointed out and distinctly claimed at the conclusion of the specification. The foregoing and other features, and advantages of the present disclosure are apparent from the following detailed description taken in conjunction with the accompanying drawings in which:

DETAILED DESCRIPTION

Figure 1:
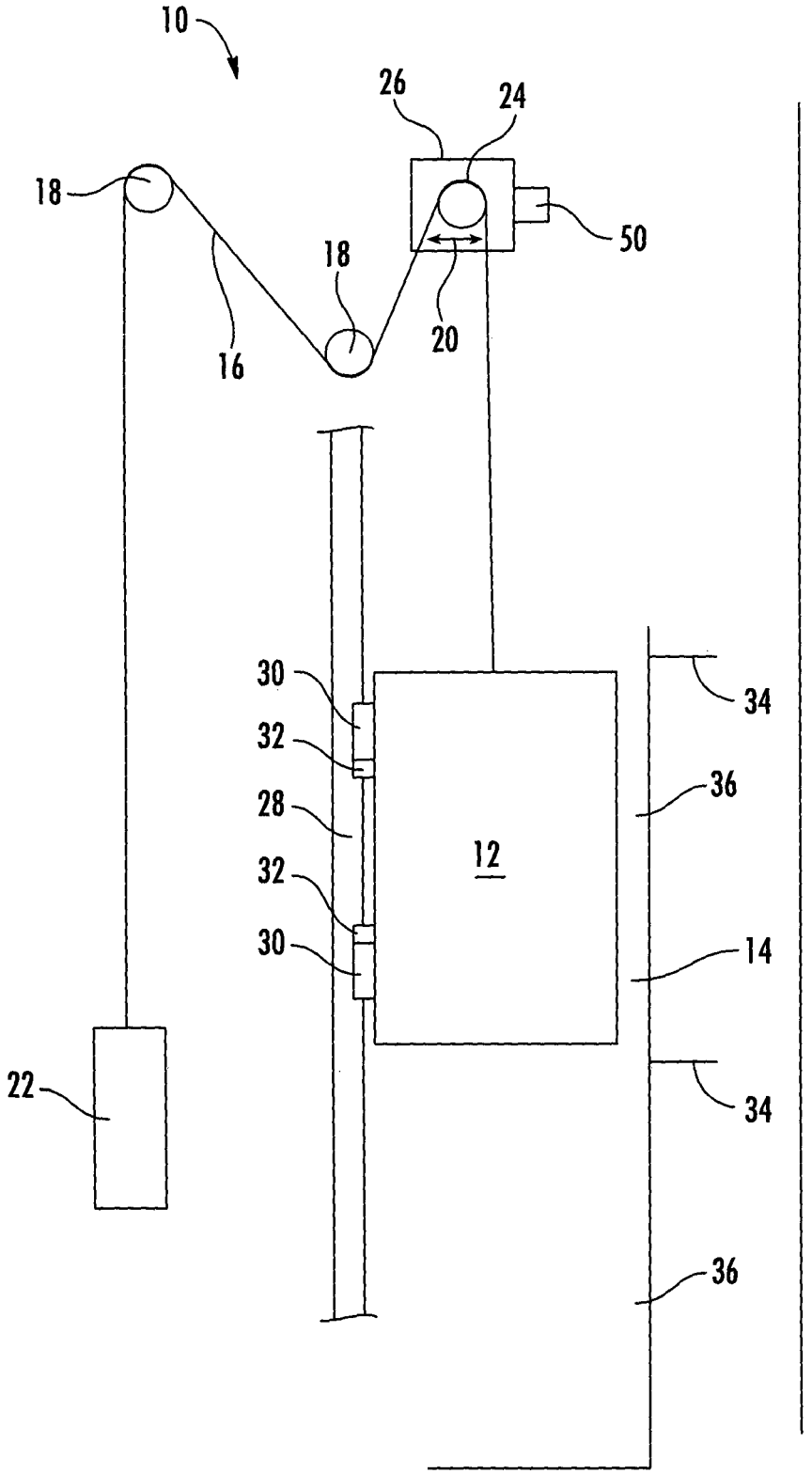
FIG. 1 is a schematic view of an embodiment of an elevator system.

Shown in FIG. 1 is a schematic of an exemplary traction elevator system 10. The elevator system 10 includes an elevator car 12 operatively suspended or supported in a hoistway 14 with one or more suspension members 16, such as ropes or belts. The one or more suspension members 16 interact with one or more sheaves 18 to be routed around various components of the elevator system 10. The one or more sheaves 18 could also be connected to a counterweight 22, which is used to help balance the elevator system 10 and reduce the difference in suspension member 16 tension on both sides of a traction sheave 24 during operation.

The elevator system 10 further includes one or more guide rails 28 to guide the elevator car 12 along the hoistway 14.

The elevator car 12 includes one or more guide shoes or rollers 30 interactive with the guide rails 28 to guide the elevator car 12. The elevator car 12 also may include safeties 32 interactive with the guide rail 28 to slow and/or stop motion of the elevator car 12 under certain conditions, such as an overspeed condition.

The hoistway 14 includes one or more landing floors 34 at which the elevator car 12 stops to allow ingress and/or egress of passengers from the elevator car 12 through elevator car doors (not shown). A landing floor door 36 is located at each landing floor 34 of the hoistway 14. During elevator system operation, the landing floor door 36 opens when the elevator car 12 is present at the landing floor 34 to allow for passenger ingress and/or egress.

Figure 2:
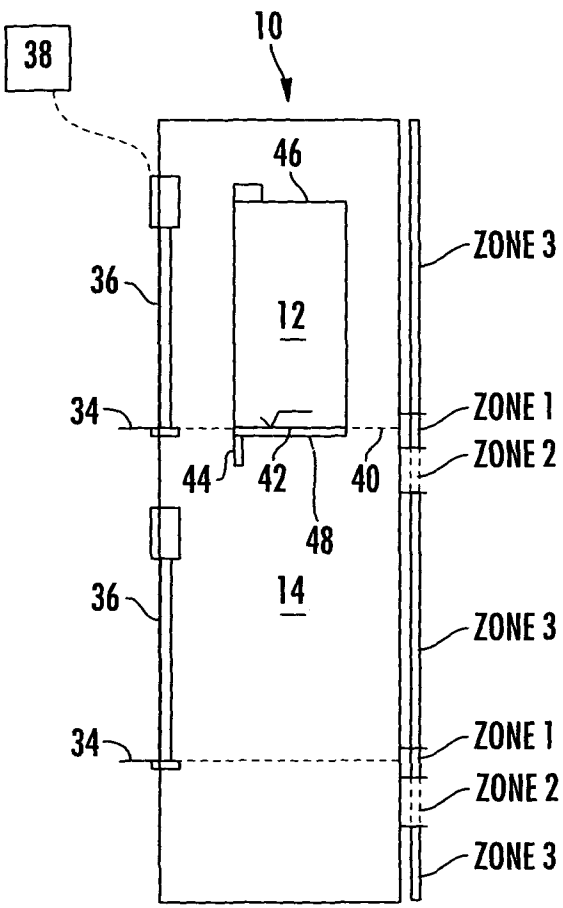
FIG. 2 is a schematic of an embodiment of an elevator system including a plurality of hoistway zones.

Referring now to FIG. 2, it is desired to prevent manual opening of the landing floor door 36 when the elevator car 12 is positioned such that a person could enter the hoistway 14 through the landing floor door 36 above or below the elevator car 12. To accomplish this, the hoistway 14 is divided into zones. When the position of the elevator car 12 is in a specific zone as defined, the landing floor door 36 may be allowed to open fully, may be allowed to open partially, or may be prevented from opening by, for example, a locking or unlocking mechanism (not shown) connected to an elevator system controller 38.

In one embodiment, the elevator zones are defined as illustrated in FIG. 2. When a reference point 40, for example a floor 42 or sill 44 is located in a particular zone, allowable function of the landing floor door 36 is determined and controlled by the elevator system controller 38. Zone 1 allows for full opening of the hoistway door 36, and in some embodiments, also allows access to an interior of the elevator car 12, due to the elevator car 12 position directly facing the landing floor door 36 when the elevator car 12 is positioned in zone 1. With the elevator car 12 positioned such that the reference point 40 is in zone 2, the landing floor door 36 may be opened to, for example, allow a maintenance worker to reach into the hoistway 14 from the landing floor 34, but not allow the maintenance worker to fully enter the hoistway 14. Further, the position of the elevator car 12 at least partially blocks entry of the maintenance worker into the hoistway 14. This allows for maintenance work to be performed on components at, for example, a top 46 or bottom 48 of the elevator car 12. In the embodiment shown in FIG. 2, positioning the elevator car 12 in zone 2 allows for access to the top 46 of the elevator car 12 through the landing floor door 36, but one skilled in the art will recognize that zone 2 may be established to allow access to the bottom 48 of the elevator car 12, or another portion of the elevator car 12. Zone 3 is generally defined as any location not in zone 1 or in zone 2. When the reference point 40 is in zone 3, the landing floor door 36 is unopenable. While three zones are shown in the figures and described herein, one skilled in the art will readily appreciate that other numbers of zones, for example, four or more zones may be defined allowing or restricting specific actions when the elevator car 12 is positioned therein.

Figure 3:
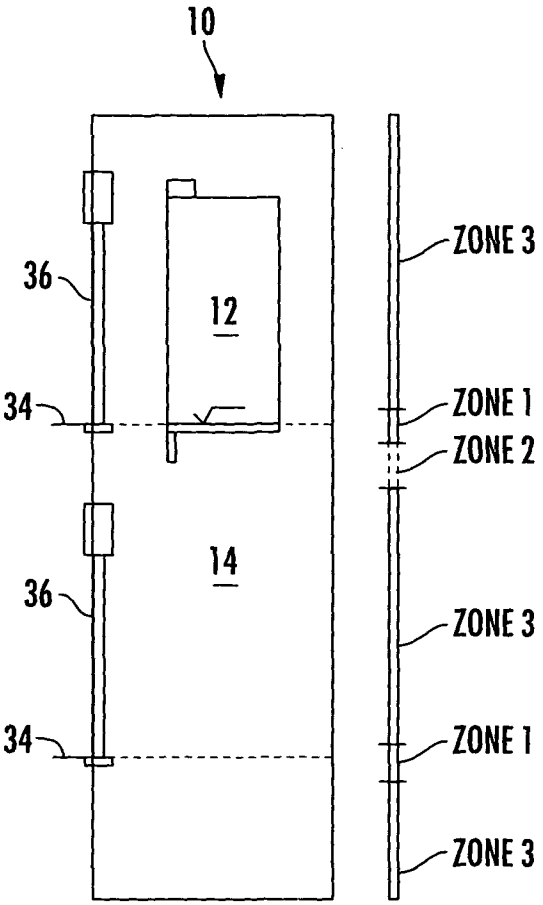
FIG. 3 is a schematic of another embodiment of an elevator system including a plurality of hoistway zones.

The elevator system controller 38 determines whether the elevator car 12 is in zone 1, zone 2 or zone 3 and interacts with the landing floor door 36 to allow or not allow operation of the landing floor door 36 and/or the extent the landing floor door 36 will open determined by the location of the elevator car 12. To determine elevator car 12 position, the elevator system controller 38 may utilize information from a car position reference system (PRS) 50, shown schematically in FIG. 1. In some embodiments, the PRS 50 may include sensors or other components fixed to the elevator car 12, and counterpart components fixed in the hoistway 14 and read by the sensors to determine the position of the elevator car 12. The counterpart components may be located in the hoistway 14 at, for example, landing door frames, guide rails 28, or a band extending along the hoistway 14. It is to be appreciated that the PRS 50 described herein is merely an example and one skilled in the art will appreciate that other configurations may be utilized to determine a position of the elevator car 12 in the hoistway 14. In the embodiment of FIG. 2, multiple zone 2's are defined along the hoistway 14. Alternatively, as shown in FIG. 3, there may not be a zone 2 proximate to each landing floor 34, but instead a single zone 2 may be defined along the hoistway 14, such that zone 2 is located at a landing floor 34 where a particular elevator system 10 component, such as where an elevator system Emergency and Inspection (E&I) Panel (not shown) is located. The E&I Panel is a cabinet accessible at the landing floor 34, sometimes integrated in a landing door frame. It is accessible for rescue, maintenance and inspection operations by authorized persons and contains control boards, power supply terminals, circuit breakers, fuses, etc. that facilitate these operations. This allows for access to the hoistway 14 to perform maintenance on the E&I Panel, as well as maintenance on exterior components of the elevator car 12.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions or equivalent arrangements not heretofore described, but which are commensurate in spirit and/or scope. Additionally, while various embodiments have been described, it is to be understood that aspects of the present disclosure may include only some of the described embodiments. Accordingly, the present disclosure is not to be seen as limited by the foregoing description, but is only limited by the scope of the appended claims.

What is claimed is:

1. An elevator system comprising:

a hoistway, the hoistway having a plurality of landing floors each landing floor having a landing floor door;

an elevator car disposed in and drivable along the hoistway; and a controller to restrict operation of the landing floor doors based on a position of the elevator car along the hoistway;

wherein the hoistway includes a first hoistway zone and a second hoistway zone, such that when the elevator car is positioned in the first hoistway zone the controller allows for opening of a corresponding landing floor door; and such that when the elevator car is positioned in the second hoistway zone the controller allows for opening of a corresponding landing floor door, without allowing entry of a person into the hoistway via the landing floor door.

2. The elevator system of claim 1, wherein the first hoistway zone is defined such that the elevator car is positioned in front of the corresponding landing floor door when positioned in the first hoistway zone.

3. The elevator system of claim 1, wherein the corresponding landing floor door is fully openable when the elevator car is positioned in the first hoistway zone.

4. The elevator system of claim 1, wherein the second hoistway zone is defined such that a top and or bottom of the elevator car is accessible through the corresponding landing floor door when the elevator car is positioned in the second hoistway zone.

5. The elevator system of claim 1, wherein the hoistway includes a third hoistway zone, such that when the elevator car is positioned in the third hoistway zone the controller prevents opening of a corresponding landing floor.

6. The elevator system of claim 1, further comprising a car position reference system operably connected to the controller to determine the position of the elevator car in the hoistway.

7. A method of operating an elevator system comprising:

driving an elevator car along a hoistway of an elevator system;

determining a position of the elevator car in the hoistway; and controlling operation of a plurality of hoistway landing floor doors based on the position of the elevator car in the hoistway;

wherein the hoistway includes a first hoistway zone and a second hoistway zone, such that when the elevator car is positioned in the first hoistway zone the controller allows for opening of a corresponding landing floor door; and such that when the elevator car is positioned in the second hoistway zone the controller allows for opening of a corresponding landing floor door, without allowing entry of a person into the hoistway via the landing floor door.

8. The method of claim 7, further comprising:

comparing the position of the elevator car to two or more predetermined hoistway zones; and allowing operation of the hoistway landing floor doors based on the predetermined zone in which the elevator car is positioned.

9. The method of claim 7, further comprising accessing atop and/or bottom of the elevator car through the corresponding landing floor door when the elevator car is positioned in the second hoistway zone.

10. The method of claim 8, further comprising a third hoistway zone such that when the elevator car is positioned in the third hoistway zone a corresponding landing floor is prevented from opening.

11. The method of claim 8, further comprising determining the position of the elevator car in the hoistway via a car position reference system.

* * * * *